US008227979B2

(12) United States Patent
Landry et al.

(10) Patent No.: US 8,227,979 B2
(45) Date of Patent: Jul. 24, 2012

(54) METHOD OF MATCHING COLOR IN LIGHTING APPLICATIONS

(75) Inventors: Daniel Landry, Troy, NY (US); David Socha, Glenmont, NY (US)

(73) Assignee: Samsung Electronics Co., Ltd. (KR)

( * ) Notice: Subject to any disclaimer, the term of this patent is extended or adjusted under 35 U.S.C. 154(b) by 335 days.

(21) Appl. No.: 12/630,223

(22) Filed: Dec. 3, 2009

(65) Prior Publication Data

US 2010/0144231 A1 Jun. 10, 2010

Related U.S. Application Data

(60) Provisional application No. 61/119,771, filed on Dec. 4, 2008.

(51) Int. Cl.

| | |
|---|---|
| ***H01J 17/49*** | (2012.01) |
| ***H01J 1/62*** | (2006.01) |
| ***H01J 63/04*** | (2006.01) |

(52) U.S. Cl. ..... 313/506; 445/3; 445/1; 445/24; 445/25; 445/58; 445/60; 313/498

(58) Field of Classification Search ..... None
See application file for complete search history.

(56) References Cited

U.S. PATENT DOCUMENTS

| | | | | |
|---|---|---|---|---|
| 7,750,359 | B2 * | 7/2010 | Narendran et al. | 257/98 |
| 8,128,249 | B2 * | 3/2012 | Skipor et al. | 362/84 |
| 2004/0233465 | A1 * | 11/2004 | Coyle et al. | 358/1.9 |
| 2011/0125120 | A1 | 5/2011 | Nishitani et al. | |
| 2011/0125129 | A1 | 5/2011 | Saab | |

OTHER PUBLICATIONS

L. Brus "Quantum Crystallites and Nonlinear Optics" Applied Physics A 53, 1991, pp. 465-474.

* cited by examiner

*Primary Examiner* — Natalie Walford
(74) *Attorney, Agent, or Firm* — Cantor Colburn LLP

(57) ABSTRACT

A method of matching a color of a light to the color of an object is presented which results in custom colored light emitting diodes.

11 Claims, 2 Drawing Sheets

Derived Data

| Scan | Radiant Flux: (Watts) no Cap | Radiant Flux: (Watts) With Pink Cap | Power Loss with Pink Cap | Luminous Flux: (lumens) no Cap | Luminous Flux: (lumens) with Cap | Lumen loss with Pink Cap |
|---|---|---|---|---|---|---|
| White Phosphor LED | 1.18E-02 | 7.81E-03 | -34% | 3.41 | 1.88 | -45% |
| Pink QD LED | 2.55E-03 | 2.12E-03 | -17% | 0.54 | 0.46 | -14% |

METHOD OF MATCHING COLOR IN LIGHTING APPLICATIONS

CROSS-REFERENCE TO RELATED APPLICATIONS

This application claims the benefit of co-pending U.S. Provisional Application No. 61/119,771, filed Dec. 4, 2008, which is hereby incorporated herein.

TECHNICAL FIELD

The present invention relates to a method of matching a light output color to the color of a physical material utilizing light emitting diodes and quantum dots as a phosphor.

BACKGROUND OF THE INVENTION

Light emitting diodes (LEDs) have become a desirable replacement for traditional lighting methods, including incandescent, fluorescent and halogen lighting. Compared to these types of lights, LEDs are much more energy efficient and may have much longer product lifetimes. A further use of such lighting may include novelty lighting with a specific color.

Semiconductor nanocrystals are typically tiny crystals of II-VI, III-V, IV-VI, or I-III-VI materials that have a diameter between 1 nanometer (nm) and 20 nm. In the strong confinement limit, the physical diameter of the nanocrystal is smaller than the bulk excitation Bohr radius causing quantum confinement effects to predominate. In this regime, the nanocrystal is a O-dimensional system that has both quantized density and energy of electronic states where the actual energy and energy differences between electronic states are a function of both the nanocrystal composition and physical size. Larger nanocrystals have more closely spaced energy states and smaller nanocrystals have the reverse. Because interaction of light and matter is determined by the density and energy of electronic states, many of the optical and electric properties of nanocrystals can be tuned or altered simply by changing the nanocrystal geometry (i.e. physical size).

Single nanocrystals or monodisperse populations of nanocrystals exhibit unique optical properties that are size tunable. Both the onset of absorption and the photoluminescent wavelength are a function of nanocrystal size and composition. The nanocrystals will absorb all wavelengths shorter than the absorption onset. However, photoluminescence will always occur at the absorption onset. The bandwidth of the photoluminescent spectra is due to both homogeneous and inhomogeneous broadening mechanisms. Homogeneous mechanisms include temperature dependent Doppler broadening and broadening due to the Heisenberg uncertainty principle, while inhomogeneous broadening is due to the size distribution of the nanocrystals. The narrower the size distribution of the nanocrystals is, the narrower the full-width at half max (FWHM) of the resultant photoluminescent spectra will be. In 1991, Brus wrote a paper reviewing the theoretical and experimental research conducted on colloidally grown semiconductor nanocrystals, such as cadmium selenide (CdSe) in particular. (Brus L., Quantum Crystallites and Nonlinear Optics, *Applied Physics A,* 53 (1991)). That research, precipitated in the early 1980's by the likes of Efros, Ekimov, and Brus himself, greatly accelerated by the end of the 1980's as demonstrated by the increase in the number of papers concerning colloidally grown semiconductor nanocrystals in past years.

SUMMARY OF THE INVENTION

A first aspect of the invention includes a method comprising: detecting a color of a material, converting the color to an RGB/CMYK value, and matching the color comprising mixing at least one population of a quantum dot into a matrix material, and placing the mixture on a light emitting diode to convert a light output of the light emitting diode to a color matching the color of the material.

A second aspect of the invention includes a system comprising: a system for detecting a color of a material; a system for converting the color to an RGB/CMYK value; and a system for matching the color comprising; a device for mixing at least one population of a quantum dot into a matrix material; and a device for placing the mixture on a light emitting diode to convert a light output of the light emitting diode to a color matching the color of the material.

The semiconductor nanocrystals, or quantum dots more specifically, useful in the present invention are described in the commonly-owned application Ser. Nos. 11/125,120 and 11/125,129. These quantum dots comprise a core semiconductor with a thin metal layer to protect from oxidation and to aid lattice matching, and a shell to enhance the luminescent properties, especially for the II-VI or III-V materials. Non-limiting examples of semiconductor nanocrystal cores include ZnS, ZnSe, ZnTe, CdS, CdSe, CdTe, HgS, HgSe, HgTe (II-VI materials), PbS, PbSe, PbTe (IV-VI materials), MN, AlP, AlAs, AlSb, GaN, GaP, GaAs, GaSb, InN, InP, InAs, InSb, InGaP (III-V materials), $CuInGaS_2$, $CuInGaSe_2$, $AgInS_2$, $AgInSe_2$, and $AuGaTe_2$ (I-III-VI materials). The metal layer is often formed of Zn or Cd, and the shell may be of the same material as the core or any of the above listed core materials.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

A method is presented comprising detecting a color of a physical material and matching that color using quantum dots. Many processes and devices are known in the art for color detection. In some embodiments, the color detection may comprise a software program such as that which ADOBE® makes combined with a charge couple device (CCD). It should be appreciated that any now known or later developed color detecting method may be utilized. In one embodiment, the method comprises converting the detected color to an RGB/CMYK value. RGB (red, green, and blue) and CMYK (cyan, magenta, yellow and key) are common models for defining a color of a physical material. In a further embodiment the method comprises matching the color with a light output. In one embodiment, matching the color with a light output comprises mixing at least one population of a quantum dot into a matrix material and placing the mixture on a light emitting diode to convert a light output of the light emitting diode matching the color of the material. In one embodiment the mixing and placing may be done via mixing by hand and using a hand dispersion technique such as a micropipette.

Methods according to some embodiments may include mixing and/or placing of the mixture using an automated process. This may be accomplished for mixing quantum dot mixtures by combining software and hardware which is capable of mixing a programmed amount of quantum dot species to reach a desired color. This process may also include automatically taking optical measurements of the light output to determine when the proper color of light is achieved. Placing the mixture on the surface of an LED or over an LED may be accomplished by using an automated dispersion device which will measure a predetermined amount of the mixture onto an LED. In some embodiments, both the mixing and placing of the quantum dot mixture may be done by the same piece of equipment.

Figure 1:
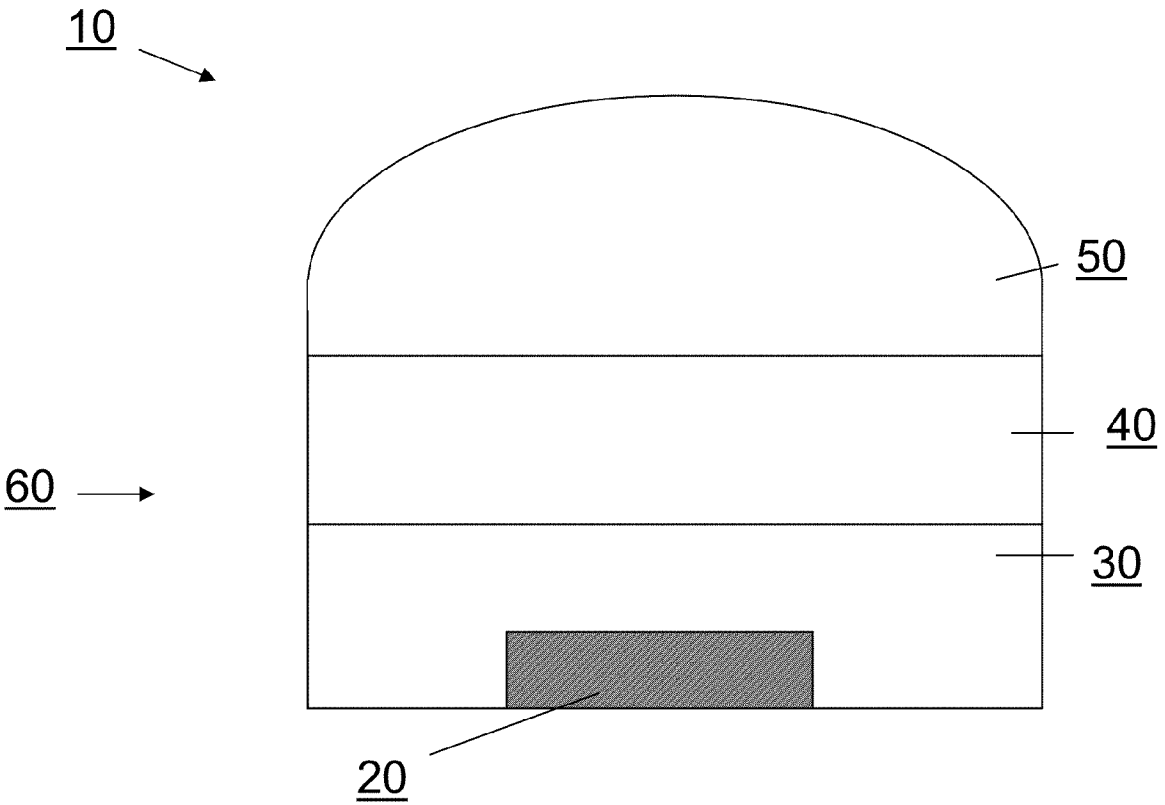
FIG. 1 shows an illustration of glass coated quantum dots within a silicone matrix placed on top of an LED chip according to an embodiment of the invention.

FIG. 1 shows a schematic view of a light-emitting device 10 such as a solid-state lighting device according to an embodiment of the invention. The light-emitting device 10 may include a light source 20 such as an LED chip, other solid-state devices such as a laser, or other light source. In some embodiments, the LED may comprise a first encapsulant layer 30 over the LED to protect it. The active layer 40 may include one or more populations of semiconductor nanocrystals admixed within a thermal or UV curable matrix material. There may also be a second encapsulant layer 50 that may form or include a lenscap, and a frame and reflector cup 60.

The active layer 40 may be made from a matrix material comprising a polymer or silicone having a plurality of cross-linked acrylate groups. One or more populations of semiconductor nanocrystals may be disposed within the matrix. The nanocrystals may also be glass coated to further protect them and enhance the lifetime of the LED. Typically, the matrix material preferably is transparent to both the wavelength of light emitted by the underlying light source and the light wavelength(s) emitted by each population of semiconductor nanocrystals dispersed within it. Non-limiting examples of acrylated polymers and silicones include urethane acrylate, polyacrylate, acrylated silicone, urethane acrylate epoxy mixture, or a combination thereof. Particularly preferred acrylated polymers or silicones are OP-54™ (Dymax) and ZIPCONE™ (Gelest).

In some embodiments it may be desired to convert the RGB/CMYK value to a CIE (International Commission on Illumination) value, as the CIE 1931 color space is measured based on human visual perception and may be more precise for matching light. By converting the physical color standard to an equivalent light color standard, quantum dot LEDs may be created which match with light the color of nearly any physical material.

In a further embodiment, the method may include making a display of at least two light emitting diodes. In such embodiments, it may be desirable to create a pattern of LEDs which have been matched to certain colors, such as a company logo or a billboard sign with an advertisement. A display may only require a few LEDs or many LEDs of many different colors. It will be appreciated that nearly any combination of LEDs of specific colors would be within the scope of the present invention.

The method may further comprise making a display using mapping software for placement of the light emitting diodes. In some embodiments, the mapping software may be incorporated into an automated device, which mixes the proper quantum dots and places the proper amounts of quantum dots onto LEDs already arranged within a display, creating the proper colors in the proper places.

In addition to modification of the LED, the 'bulb', or the structure placed over the LED, can be customized in order to achieve colors with higher K values in CMYK coordinates. In such a case the appropriate dyes may be added to the bulb including a black dye for the K value. This decreases the overall light output from the diode but allows for 'darker' colors to be achieved. The unique narrow emission spectra from the quantum dots allows for quantum dots to be selected so as to allow maximum light output in the desire color range. This may be achieved by choosing a quantum dot phosphor which has a lower absorption in the wavelengths which are blocked by the colored bulb.

Figure 2:
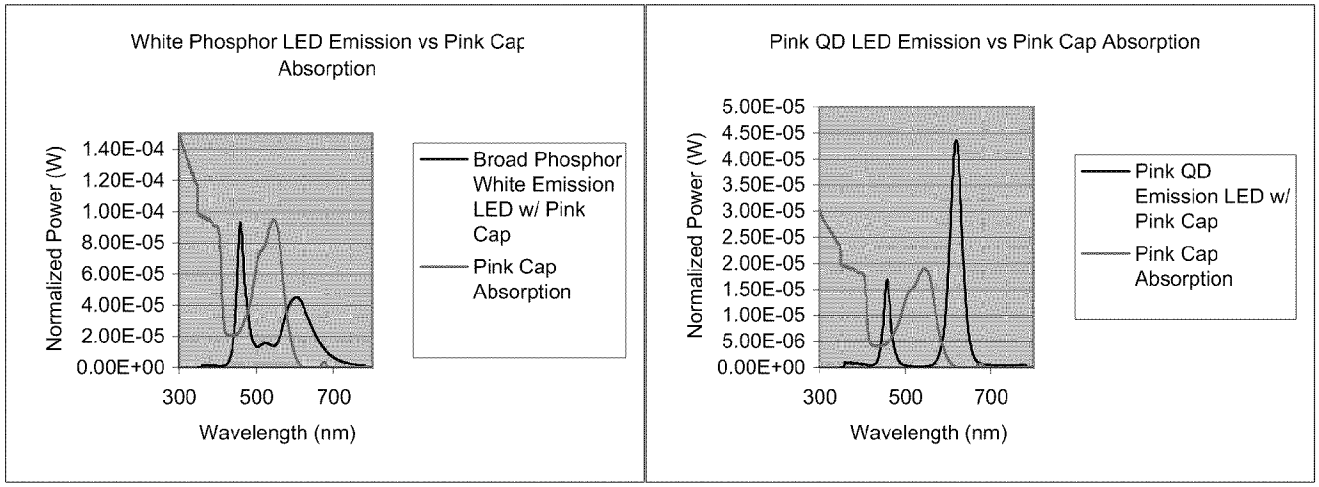
FIG. 2 shows a comparison of light output from a traditional white phosphor LED with a pink cap to a pink quantum dot LED with a pink cap.

FIG. 2 shows a comparison of a pink LED using a traditional white phosphor and a pink cap versus a pink quantum dot phosphor combination and a pink cap. The resulting light output using the quantum dot phosphor is approximately twice that of the traditional white phosphor with the pink cap. By closely matching the light output of an LED to the color of the cap, less of the overall light is absorbed by the bulb, as compared to a traditional white LED. The traditional white LED typically has most of the light at wavelengths higher than the bulb, if not all of it, absorbed, resulting in novelty lighting which is much less bright.

Below are provided several examples of color matched light emitting diodes and methods useful in practicing various embodiments of the invention.

EXAMPLE 1

In the case the underlying LED is a UV source, concentrations of blue emitting quantum dots, green emitting quantum dots, and red emitting quantum dots may be mixed to match the color.

EXAMPLE 2

In the case the underlying LED is a blue source, concentrations of green emitting quantum dots, yellow to orange emitting quantum dots, and red to near infrared (NIR) emitting quantum dots may be mixed to match the color.

The foregoing description of various aspects of the invention has been presented for the purpose of illustration and description. It is not intended to be exhaustive or to limit the invention to the precise form disclosed, and obviously, many modifications and variations are possible. Such variations and modifications that may be apparent to one skilled in the art are intended to be included within the scope of the present invention as defined by the accompanying claims.

What is claimed is:

1. A method comprising:

detecting a color of a material;

converting the color to an RGB/CMYK value; and matching the color comprising;

mixing at least one population of a quantum dot into a matrix material; and placing the mixture on a light emitting diode to convert a light output of the light emitting diode to a color matching the color of the material.

2. The method of claim 1, wherein at least one of the mixing and placing of the mixture uses an automated process.

3. The method of claim 1, further comprising converting the RGB/CMYK value to a CIE value.

4. The method of claim 1, further comprising making a display of at least two light emitting diodes.

5. The method of claim 4, wherein making a display utilizes a mapping software for a placement of the light emitting diodes.

6. The method of claim 1, wherein the matrix material is selected from a group consisting of: thermally-curable matrix materials and ultraviolet (UV)-curable matrix materials.

7. The method of claim 1, wherein the matrix material includes at least one matrix material selected from a group consisting of: urethane acrylate, polyacrylate, acrylated silicone, urethane acrylate epoxy mixture, and combinations thereof.

8. The method of claim 1, wherein the matrix material includes a silicon matrix material.

9. A system comprising:

a system for detecting a color of a material;

a system for converting the color to an RGB/CMYK value; and a system for matching the color comprising;

a device for mixing at least one population of a quantum dot into a matrix material; and a device for placing the mixture on a light emitting diode to convert a light output of the light emitting diode to a color matching the color of the material.

10. The system of claim 9, wherein the device for mixing includes an automated device.

11. The system of claim 9, wherein the device for placing includes an automated device.

* * * * *